US005515032A

United States Patent [19]

Johnson

[11] Patent Number: 5,515,032

[45] Date of Patent: May 7, 1996

[54] ALARM DEVICE

[75] Inventor: Raymond C. Johnson, Bonaire, Ga.

[73] Assignee: ICI Americas Inc., Wilmington, Del.

[21] Appl. No.: 385,337

[22] Filed: Feb. 8, 1995

[51] Int. Cl.[6] ..... G08B 13/14

[52] U.S. Cl. ..... 340/571; 340/529

[58] Field of Search ..... 340/571, 529

[56] References Cited

U.S. PATENT DOCUMENTS

| | | | |
|---|---|---|---|
| 2,041,577 | 5/1936 | Sutherland | 340/571 |
| 3,564,525 | 2/1971 | Robeson et al. | 340/571 |
| 3,633,194 | 1/1972 | Kothe | 340/550 |
| 3,685,037 | 8/1972 | Bennett et al. | 340/568 |
| 3,750,583 | 8/1973 | White et al. | 102/481 |
| 3,781,860 | 12/1973 | Freyling, Jr. | 340/571 |
| 3,828,341 | 8/1974 | Carter, Jr. | 340/571 |
| 3,836,901 | 9/1974 | Matto et al. | 340/571 |
| 4,030,087 | 6/1977 | Ritchie et al. | 340/571 |
| 4,267,553 | 5/1981 | Vogelsanger et al. | 340/571 |
| 4,327,360 | 4/1982 | Brown | 340/571 |
| 4,511,888 | 4/1985 | Bernhardt | 340/571 |
| 4,559,529 | 12/1985 | Bernhardt | 340/571 |
| 4,639,716 | 1/1987 | Payne | 340/571 |
| 4,686,514 | 8/1987 | Liptak, Jr. et al. | 340/571 |
| 4,833,456 | 5/1989 | Heller | 340/571 |
| 4,908,606 | 3/1990 | Kevonian | 340/571 |
| 4,908,608 | 3/1990 | Reinke et al. | 340/571 |
| 4,975,680 | 12/1990 | Fogle, Jr. | 340/571 |
| 4,985,695 | 1/1991 | Wilkinson et al. | 340/571 |
| 5,001,461 | 3/1991 | Vroom et al. | 340/571 |
| 5,091,713 | 2/1992 | Horne et al. | 340/541 |
| 5,130,695 | 7/1992 | Scarbrough et al. | 340/527 |
| 5,172,093 | 12/1992 | Nose et al. | 340/529 |
| 5,573,043 | 2/1986 | Heuker of Hoek et al. | 340/571 |

FOREIGN PATENT DOCUMENTS

WO93/02435 2/1993 WIPO .

*Primary Examiner*—Glen Swann, III
*Attorney, Agent, or Firm*—Howson & Howson

[57] ABSTRACT

An anti-theft alarm to be concealed within an article likely to be stolen causes an alarm such as release of smoke, tear gas, dye. The alarm is responsive to continual motion and requires an initial motion followed by motion in each of a series of intervals following the initial motion.

9 Claims, 3 Drawing Sheets

ALARM DEVICE

SUMMARY OF THE INVENTION

This invention relates to alarm devices, and more particularly to improvements in anti-theft alarms of the type which are physically attached to packets of currency or other articles, and which release dye, smoke or tear gas, produces noise, or otherwise produce an alarm when the articles are moved without authorization.

A typical application for an alarm device of this kind is the currency alarm pack used by bank tellers to foil robberies. A currency alarm pack has the appearance of ordinary currency, but includes a concealed alarm device which explosively releases dye or produces other audible or visible alarms to facilitate detection of theft and apprehension of the perpetrator. In the case of a bank robbery, for example, the teller may include an alarm pack among packs of currency delivered to the robber. A timer in the alarm pack triggers a squib at the end of a predetermined delay, causing the release of dye and tear gas which makes the stolen currency identifiable and temporarily disables the robber.

One form of currency alarm pack for thwarting bank robbers is described in U.S. Pat. No. 3,828,341, issued on Aug. 6, 1974 to C. H. Carter and S. M. Newfeld. The alarm pack is normally maintained in a de-activated condition by a magnetic "keeper" in the teller's cash drawer. A timer in the alarm pack is activated by a localized alternating magnetic exit field generated adjacent to the exit of the bank. For the alarm to be triggered, the alarm pack must first be removed from the keeper, taken into the field and then moved out of the field. When the alarm pack is moved out of the field, the timer is activated. Then, at the end of a timing interval, the alarm is triggered. Provision is made in the alarm circuitry for resetting the timer to prevent triggering of the alarm if the robber returns to the field before the timer triggers the alarm.

One of the principal drawbacks in the use of alarm packs of the kind described in the Carter and Newfeld patent is the requirement for a magnetic or electromagnetic field. A transmitter must be located at each exit door. The field must be directional and localized. The transmitter must be disguised or hidden so that it is not noticeable. All of these requirements make the installation of the transmitters labor-intensive and expensive.

Attempts have been made to produce alarm packs which do not require a field. In these alarm packs a timer was activated when the alarm pack was removed from a keeper or "safety plate." The alarm was activated after the elapse of a predetermined time interval following removal of the alarm pack from the keeper. One difficulty with alarm packs of this kind was that the article in which the alarm pack was incorporated could be accidentally removed from the keeper. Unless the article was returned to the keeper within the predetermined time, unintended triggering of the alarm would occur.

The principal object of this invention is to provide an anti-theft alarm which does not require an exit field, but which is resistant to accidental triggering.

It is also an object of the invention to provide an anti-theft alarm which is highly reliable in its operation so that it cannot be easily defeated by a thief.

Still another object of the invention is to provide an anti-theft alarm which does not require an exit field, and which is capable of being used both with and without a keeper.

To address these objects, the alarm device in accordance with the invention comprises motion detection means; means for producing an alarm; and logic and timing means, responsive to the motion detection means, for causing the alarm means to produce an alarm only if two conditions occur. First, the motion detection means must detect an initial motion. Second, the motion detection means must detect a predefined pattern of continual motion following the initial motion. Preferably, the predefined pattern consists of motion in each of a plurality of predetermined successive intervals following the initial motion.

In a preferred embodiment of the invention, timing means establishes first and second predetermined intervals, the latter being made up of a succession of predetermined sub-intervals. The alarm is produced following the end of the second predetermined interval. Logic means, responsive to the motion detection means, controls the timing means so that the timing means begins the first predetermined interval after an initial motion is detected, and the second predetermined interval begins upon detection of additional motion within the first predetermined interval. The alarm is produced only if three conditions occur. First the motion detection means must detect an initial motion. Second, the motion detection means must detect additional motion during the first predetermined interval. Third, the motion detection means must detect motion in each of the sub-intervals.

As will be apparent from the detailed description to follow, occasional inadvertent motion of an alarm-protected object by a bank teller or store clerk will be momentary and will not trigger an alarm. A thief, whose objective is normally to remove the object from the premises as quickly as possible, is almost certain to move the object in a pattern of continual motion which triggers the alarm.

Further objects and advantages of the invention will be apparent from the following detailed description when read in conjunction with the drawings.

DETAILED DESCRIPTION

The alarm device is adapted to be incorporated into a false currency pack or into a package likely to be stolen by shoplifting, such as a cigarette carton. The heart of the alarm device is a circuit board having mounted on it the components depicted schematically in FIG. 1.

Figure 1:
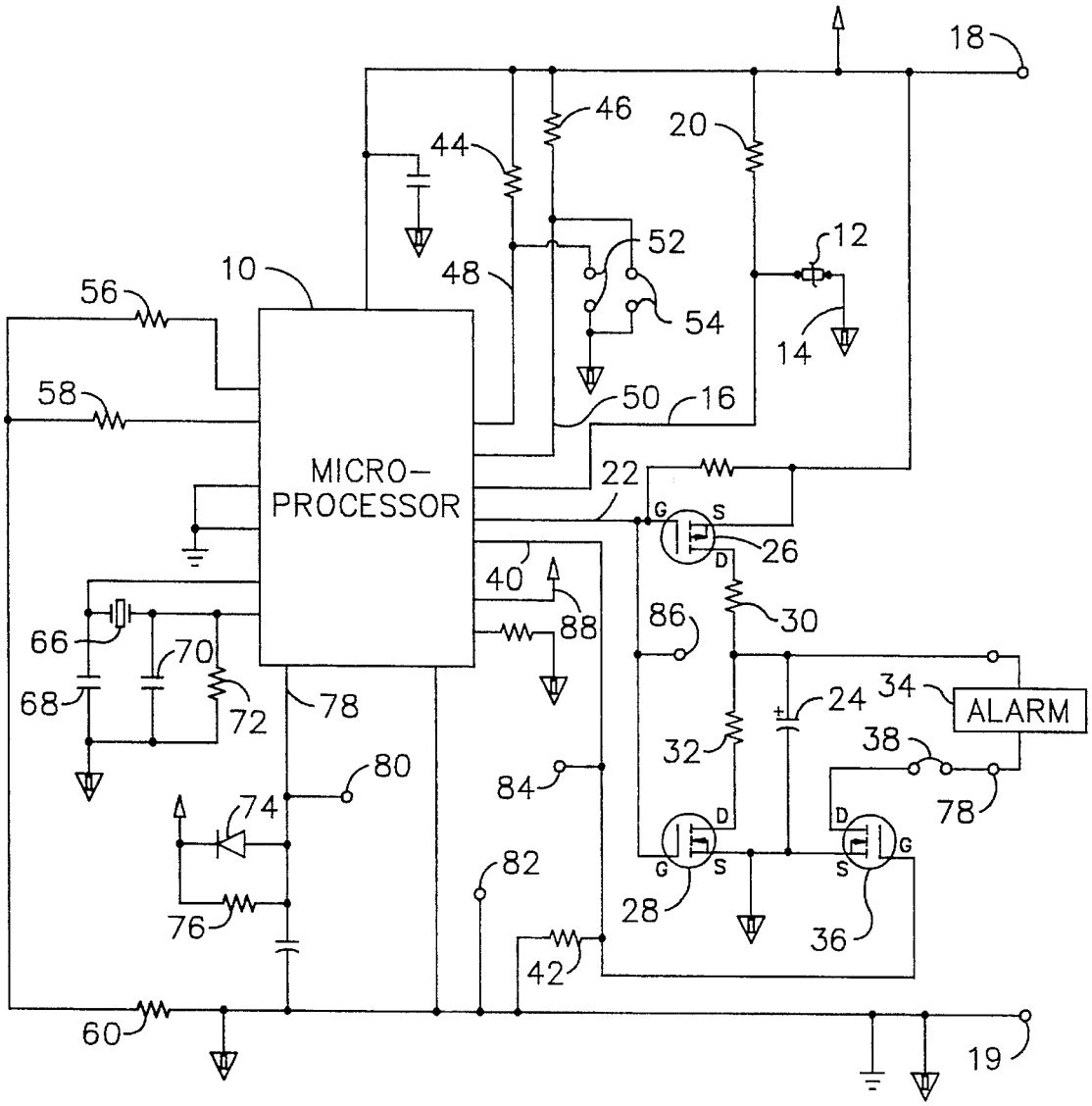
FIG. 1 is a schematic diagram showing the electrical circuitry of the alarm device of the invention.

The circuit of FIG. 1 is a microprocessor-based, motion-responsive control for activating an alarm upon the detection of motion in a predetermined pattern.

The microprocessor 10 is a Microchip Technology PIC16C71 microprocessor, which has a built in programmed read-only memory. The microprocessor is pre-programmed to carry out the logic operations depicted in FIGS. 2 and 3.

A sensitive, motion-sensing mercury switch 12 is connected between the device ground 14 and a microprocessor input line 16. Line 16 is held positive, when switch 12 is open, by connection with a positive battery supply terminal 18 through resistor 20. A negative battery terminal 19 is connected to the device ground.

The microprocessor 10 has an output 22, which controls the charging of a capacitor 24 through a charging circuit comprising a complementary pair of insulated gate, field effect transistors (IGFETs) 26 and 28.

IGFET 26 is a P-channel, enhancement mode device having its source connected to positive battery terminal 18 and having its drain connected to one terminal of capacitor 24 through resistor 30. The opposite terminal of the capacitor is connected to the device ground.

IGFET 28 is an N-channel, enhancement mode device having its source connected to the device ground, and having its drain connected through resistor 32 to the ungrounded terminal of capacitor 24.

The gates of both IGFETs are connected to microprocessor output 22. When the device is in an inactive condition, the microprocessor holds its output 22 in a positive or "high" condition, so that IGFET 26 is cut off while IGFET 28 is in conduction, thereby maintaining capacitor 24 in a discharged condition. When microprocessor output 22 goes low, IGFET 28 is cut off and no longer short-circuits capacitor 24. IGFET 26, at the same time goes into conduction, and capacitor 24 is charged from the positive battery terminal through resistor 30.

An alarm 34 comprises a pyrotechnic squib which is fired by the discharge of capacitor 24. One terminal of the alarm is connected to the ungrounded terminal of capacitor 24 and the other terminal of the alarm is connected to the device ground through the source-drain circuit of another N-channel, enhancement mode IGFET 36. A removable jumper 38 is provided to disable the alarm for shipment and testing. The gate of IGFET 36 is connected to microprocessor output 40, which is normally held "low" by connection through resistor 42 to the device ground. The squib of the alarm is fired when microprocessor output 40 goes "high" while capacitor 24 is charged.

Resistors 44 and 46 are connected respectively to microprocessor inputs 48 and 50. Input 48 can be short circuited to the device ground by a connecting a jumper across jumper terminals 52. Similarly, input 50 can be short circuited to the device ground by a connecting a jumper across jumper terminals 54. These jumpers can be used to select countdown times as will be explained later with reference to FIGS. 2 and 3.

Resistors 56 and 58 are used to ground unused inputs of microprocessor 10. These resistors are returned to the device ground through resistor 60. Crystal 66, which is associated with capacitors 68 and 70 and resistor 72, controls a clock oscillator for the microprocessor. Diode 74 and resistor 76 are connected between the positive battery terminal and microprocessor input 78, and provide for resetting of the microprocessor when the battery is initially connected to the battery terminals 18 and 19. Test points are provided at 80, 82, 84 and 86. The microprocessor has another terminal 88 connected to the positive battery terminal.

Figure 2:
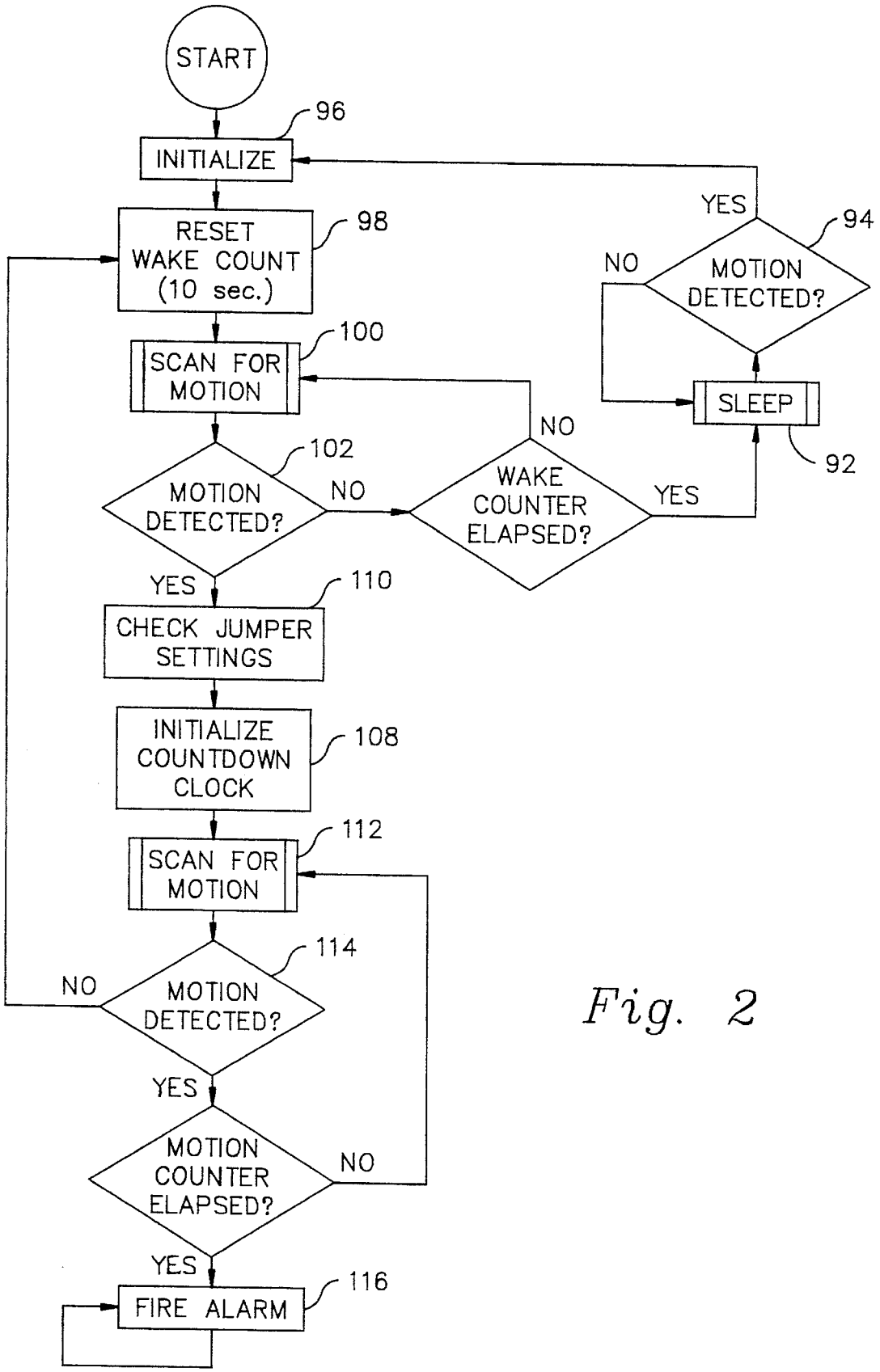
FIG. 2 is a flow diagram illustrating the operation of the alarm device.
Figure 3:
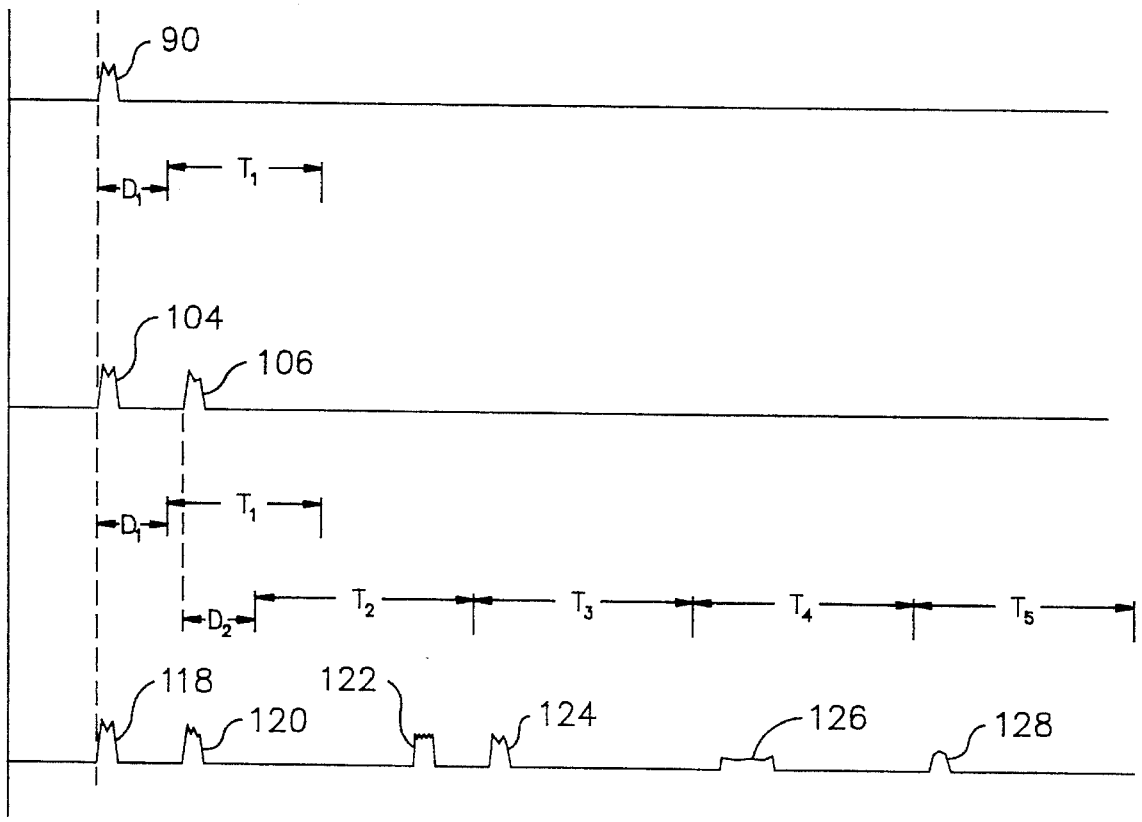
FIG. 3 is a plot of device motion against time, further illustrating the operation of the alarm device.

The operation of the device of FIG. 1 is determined by the programming of microprocessor 10, and is illustrated by FIGS. 2 and 3. Time intervals are established in the microprocessor by counting clock pulses.

At rest, the device is in a "sleep" state in which the current demand of the microprocessor is held at a low level to conserve battery energy.

The upper part of FIG. 3 depicts an initial motion 90 followed by no further motion. The initial motion 90 is detected by motion sensor 12, which causes the microprocessor 10 to come out of the "sleep" state, and after a short delay $D_1$ of approximately one second, to begin a "wake count" interval $T_1$ having a short duration, for example ten seconds. As shown in FIG. 2, the device is in a "sleep" state at 92, and detection of the initial motion at 94, initializes the microprocessor at 96, placing it in an "awake" state, resetting the "wake count" at 98 and beginning a scan, at 100, for further motion during the ten second interval $T_1$. If no motion is detected at 102, the device continues to scan for motion until the ten second wake count interval $T_1$ has elapsed. No further motion being detected during the ten second wake count interval $T_1$, upon the completion of the ten second interval, the device returns to the "sleep" state at 92.

The middle part of FIG. 3 depicts an initial motion 104 followed by a further motion 106 detected during the wake count interval $T_1$. The further motion 106 is detected by the motion sensor 12 and, after a short delay $D_2$, a sub-interval $T_2$, typically fifteen seconds in duration, begins, during which the device scans for further motion.

As shown in FIG. 2, the second motion 106 is detected at 102. The microprocessor is programmed to scan for motion in each interval of a series of successive sub-intervals $T_2$, $T_3$, $T_4$ and $T_5$. If motion is detected in one such sub-interval, the device looks for motion in the next sub-interval. As shown in FIG. 2, at 108, the microprocessor initializes a countdown clock, which determines the duration of each of the sub-intervals beginning with $T_2$. The number of these sub-intervals depends upon the presence of jumpers at terminals 52 and 54. In FIG. 3, the device counts four such sub-intervals for a total countdown interval of one minute. However, depending upon the jumper settings, the device may count eight or twelve fifteen second sub-intervals, for a total countdown interval of either two or three minutes.

In FIG. 2, the jumper settings are checked at 110, and the microprocessor scans for motion at 112. If no motion is detected at 114, the device reverts to its initial condition in which the "wake count" is reset, and looks for a motion corresponding to motion 106 in the wake count interval $T_1$. If no such motion is detected in $T_1$, the device reverts to its initial "awake" state and looks for motion in wake count interval $T_1$. If motion is detected in $T_1$, the device begins to look for motion in sub-interval $T_2$. On the other hand, if motion is detected in sub-interval $T_2$ the device looks for motion in $T_3$. The device continues to look for motion in each sub-interval, beginning with $T_2$, until a sub-interval occurs in which no motion has been detected, or until the last sub-interval has elapsed, as determined by the predetermined count established by the jumper settings at terminals 52 and 54. At the end of the last such sub-interval, the alarm is activated at 116.

In the operation depicted in the middle of FIG. 3, an initial motion is detected at 104 and is followed by a further motion at 106. The device scans for motion during sub-interval $T_2$, but as no motion is detected in $T_2$, and no further motion follows within approximately eleven seconds ($D_2$+$T_1$), the device reverts to its initial "awake" state and ultimately to its "sleep" state.

As shown at the bottom of FIG. 3, an initial motion 118 is followed by motion 120 within interval $T_1$. Motion is detected within each of sub-intervals $T_2$, $T_3$, $T_4$ and $T_5$ at 122, 124, 126 and 128. The alarm is activated immediately at the end of the last sub-interval $T_5$.

The operation of the device may be summarized as follows. The device is normally in a "sleep" state in which the current demand of the microprocessor is as low as possible to avoid excessive battery drain. The device comes out of its "sleep" state and enters an "awake" state upon detection of an initial motion. It then looks for additional motion during a ten second interval $T_1$. If it does not detect motion it returns to its "sleep" state. If it detects motion during $T_1$, it begins to count a predetermined countdown interval of one, two or three minutes, depending upon the setting of the jumpers at terminals 52 and 54. The predetermined countdown interval is made up of a series of successive fifteen second sub-intervals. The device looks for motion in each of the sub-intervals of the preselected countdown interval. If motion is detected in each sub-interval, the device fires the alarm at the end of the last sub-interval. On the other hand, if, in any sub-interval, no motion is detected, the device returns to the condition it was in when it initially entered its "awake" state.

The device can be incorporated into an article likely to be stolen or tampered with, and can activate smoke, tear gas, dye or any other alarm. No exit field is needed, and the device is highly resistant to unintended activation by authorized persons because, if such persons move an article, they will normally replace it promptly so that there is no continual motion of the article as required for activation of the alarm. A thief, however, is almost certain to move the article in a pattern of motion which will result in activation of the alarm.

Various modifications can be made to the alarm device described above. For example, while no keeper or "safety plate" is required, it is possible to provide a magnetic keeper at the location where the protected article is normally stored, and to incorporate a magnetic switch into the alarm circuit so that the alarm cannot be activated by motion while it is in proximity to the keeper. Alternatively, the initial motion can be detected by means of a magnetic switch instead of being detected by mercury switch 12. The predetermined pattern of motion which results in alarm activation can be varied by programming the microprocessor in such a way as to lengthen or shorten some of the sub-intervals which make up the countdown interval. While, in the preferred embodiment, the logic and timing of the device are implemented by a microprocessor, the invention can be embodied in a device using discrete logic or programmed array (PAL) logic. In still another modification, the device can be made to activate the alarm immediately upon detection of motion in the last of the series of sub-intervals making up the countdown interval. Numerous other modifications can be made to the device described herein without departing from the scope of the invention as defined in the following claims.

I claim:

1. An alarm device adapted to be fixed to an article, for giving an alarm in response to unauthorized movement of the article, the alarm device comprising:

motion detection means;

means for producing an alarm; logic and timing means, responsive to said motion detection means, for causing said alarm means to produce an alarm only if:

(a) the motion detection means detects an initial motion; and (b) the motion detection means detects a predefined pattern of continual motion following said initial motion, and means for reducing the electrical current demand of said logic and timing means if no motion is detected by said detection means within a predetermined interval following detection of said initial motion.

2. An alarm device adapted to be fixed to an article, for giving an alarm in response to unauthorized movement of the article, the alarm device comprising:

motion detection means;

means for producing an alarm; and logic and timing means, responsive to said motion detection means, for causing said alarm means to produce an alarm only if:

(a) the motion detection means detects an initial motion; and (b) the motion detection means detects motion in each of a plurality of predetermined successive intervals following said initial motion.

3. An alarm device according to claim 2 including means for resetting said logic and timing means when, in any of said predetermined successive intervals, the motion detection means does not detect motion.

4. An alarm device according to claim 2 including means for reducing the electrical current demand of said logic and timing means if no motion is detected by said detection means within a predetermined interval following detection of said initial motion.

5. An alarm device according to claim 2 including means for adjusting the number of said predetermined successive intervals in said plurality of predetermined successive intervals.

6. An alarm device adapted to be fixed to an article, for giving an alarm in response to unauthorized movement of the article, the alarm device comprising:

motion detection means;

means for producing an alarm;

timing means for establishing a first predetermined interval and a second predetermined interval, the second predetermined interval consisting of a succession of predetermined sub-intervals, and for causing said alarm producing means to produce an alarm following the end of said second predetermined interval; and logic means, responsive to said motion detection means, for controlling said timing means so that the timing means begins said first predetermined interval after detecting an initial motion, initiates said second predetermined interval upon detecting additional motion within said first predetermined interval, and produces said alarm only if:

(a) the motion detection means detects said initial motion; and (b) the motion detection means detects additional motion during said first predetermined interval; and (c) the motion detection means detects motion in each of said sub-intervals.

7. An alarm device according to claim 6 including means for resetting said timing means when the motion detection means does not detect motion in said first predetermined interval and when, in any of said predetermined successive intervals, the motion detection means does not detect motion.

8. An alarm device according to claim 6 including means for reducing the electrical current demand of said logic means and timing means when the motion detection means does not detect motion in said first predetermined interval.

9. An alarm device according to claim 6 including means for adjusting the number of said sub-intervals which constitute said second predetermined interval.

* * * * *